US006382316B1

(12) United States Patent
Kintzele

(10) Patent No.: US 6,382,316 B1
(45) Date of Patent: May 7, 2002

(54) METHOD AND SYSTEM FOR PRODUCING FLUIDS IN WELLS USING SIMULTANEOUS DOWNHOLE SEPARATION AND CHEMICAL INJECTION

(75) Inventor: Matthew J. Kintzele, Iraan, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 09/564,089

(22) Filed: May 3, 2000

(51) Int. Cl.[7] ..... E21B 43/38; E21B 43/22

(52) U.S. Cl. ..... 166/265; 166/90.1; 166/105.5; 166/305.1

(58) Field of Search ..... 166/90.1, 105.5, 166/263, 265, 269, 270.1, 275, 305.1, 369

(56) References Cited

U.S. PATENT DOCUMENTS

| | | | | |
|---|---|---|---|---|
| 4,387,770 A | | 6/1983 | Hill | |
| 4,390,061 A | * | 6/1983 | Short | 166/53 |
| 4,690,217 A | * | 9/1987 | Taggart et al. | 166/274 |
| 5,127,457 A | | 7/1992 | Stewart et al. | |
| 5,296,153 A | | 3/1994 | Peachey | |
| 5,343,945 A | | 9/1994 | Weingarten et al. | |
| 5,456,837 A | | 10/1995 | Peachey | |
| 5,464,059 A | | 11/1995 | Kristiansen | |
| 5,730,871 A | | 3/1998 | Kennedy et al. | |
| 5,996,692 A | * | 12/1999 | Chan et al. | 166/263 |
| 6,017,456 A | | 1/2000 | Kennedy et al. | |
| 6,082,452 A | * | 7/2000 | Shaw et al. | 166/105.5 |
| 6,089,317 A | * | 7/2000 | Shaw | 166/265 |

OTHER PUBLICATIONS

"Completion Design for Downhole Water and Oil Separation and Invert Coning," by Arthur Loginov and Christopher Shaw, SPE 38829, Presented at the 1997 SPE Annual Technical Conference and Exhibition. pp. 801–809.

* cited by examiner

*Primary Examiner*—David Bagnell
*Assistant Examiner*—Jennifer Dougherty
(74) *Attorney, Agent, or Firm*—Jack E. Ebel

(57) ABSTRACT

A method and a system for producing fluids, particularly hydrocarbons and water, from a subterranean well are provided. The method and system can be used with a well in which the production zone is above the injection zone, or with a well in which the production zone is below the injection zone. The method includes the step of separating a well fluid into a hydrocarbon stream and a separate water stream, while simultaneously injecting a chemical into a selected zone of the well. The system includes a downhole separation system for performing the separating step, and a chemical injection system for performing the injecting step. The separation system can include a separator apparatus for separating the well fluid into the separate streams, an injection pump for pumping the well fluid into the separator apparatus, and a hydrocarbon pump for pumping the hydrocarbon stream to the surface, The chemical can be injected into a production zone of the well and transported by the water stream into an injection zone of the well, such that both well zones are treated by the chemical. Alternately, the chemical can be injected directly into the injection zone of the well.

37 Claims, 4 Drawing Sheets

METHOD AND SYSTEM FOR PRODUCING FLUIDS IN WELLS USING SIMULTANEOUS DOWNHOLE SEPARATION AND CHEMICAL INJECTION

FIELD OF THE INVENTION

This invention relates generally to the production of fluids from subterranean wells. More specifically, this invention relates to a method and to a system for producing fluids from subterranean wells using downhole fluid separation and chemical injection in combination.

BACKGROUND OF THE INVENTION

Oil wells and gas wells are used to obtain production fluids from earth formations such as geological reservoirs. Production fluids from these wells consist of hydrocarbons and water. For example, a typical production fluid contains about 2%–20% hydrocarbons, and about 80%–98% water. Once the production fluid is produced to the surface, the hydrocarbons are separated from the water using well known techniques, and marketed as a "produced fluid". The separated water is referred to as a "produced water".

One technique for increasing productivity in a well involves separating the hydrocarbons and the water in the well using a downhole separation system. For example, a separation system can include a hydrocyclone, or similar mechanical separator, for separating a well fluid into a hydrocarbon stream and water stream using fluid density differences, Rather than mechanical separation, other types of separation systems can utilize filters, membranes and electrostatic devices. Typically, the hydrocarbon stream is pumped from a producing zone of the well to the surface, and the water stream is injected into an injection zone of the well. In addition to mechanical separators, conventional downhole separation systems utilize packers to isolate the different zones, and pumps to generate the necessary fluid flow paths and pressure differentials.

The benefits accruing from downhole fluid separating techniques include reduced production costs, reduced $H_2S$ emissions, reduced scale formation, and general operational and environmental benefits from lower waste fluid volumes at the surface. In addition, the injection of water into lower reservoir zones can yield incremental production and reserves due to a "water flood" response.

Another technique for increasing productivity in a subterranean well involves the injection of chemicals into the well. The chemicals can be injected into a particular zone of the well to enhance hydrocarbon recovery. A chemical injection into a producing well is sometimes termed a "huff and puff" due to injection of the chemical, followed by production from the well using the same well bore.

In the prior art, fluid separating techniques and chemical injection techniques have been performed separately. The present invention recognizes that fluid separating and chemical injection techniques can be used in combination for producing fluids from oil and gas wells. This results in reduced costs, reduced emissions, reduced scale formation, and increased well production.

SUMMARY OF THE INVENTION

In accordance with the present invention, a method and a system, for producing fluids in subterranean wells, are provided. The method can be performed on a conventional oil or gas production well extending from an earthen surface, into a production zone and an injection zone within the earth. In addition, the production well can include a well casing, production tubing within the well casing, and a well annulus between the production tubing and the well casing.

The method, simply stated, comprises separating hydrocarbons and water in the well, while simultaneously injecting a chemical into the well to treat selected zones of the well. A downhole separation system can be used to perform the separating step, and a chemical injection system can be used to perform the injecting step. In a first embodiment the method is performed in a well in which the production zone is above the injection zone (i.e., the production zone is closer to the surface). In a second embodiment the method is performed in a well in which the production zone is below the injection zone (i.e., the injection zone is closer to the surface).

In either embodiment, using the separation system, well fluids from the production zone of the well are downhole separated into a first stream comprising essentially hydrocarbons, and into a second stream comprising essentially water. The first stream (hydrocarbon) is pumped through the production tubing to the surface, while the second stream (water) is injected into the injection zone of the well.

For treating the well during the separation process, the chemical can be injected through the well annulus, or through a separate conduit into the selected zone. The chemical can comprise any chemical compound configured to increase the productivity of the well. Preferably the chemical has an affinity for water to permit separation from the first stream (hydrocarbon), and inclusion in the second stream (water). The first stream (hydrocarbon) which is produced to the surface, is thus essentially free of the chemical, and the second stream (water) disposes of the chemical. Representative chemicals include surfactant compounds, wettability altering compounds, and remediating compounds.

The chemical injection step can be performed one time for a time period sufficient to achieve a desired treatment of the well zone. For example, the injection step can be performed once for a selected time period, and then discontinued as separation and production of the first stream (hydrocarbon), and the second stream (water) continues. However, the injection step can also be performed continuously with the production of the separate fluids. The injection step can also be performed cyclically in an on-off sequence.

In addition to producing separate fluids, the method also chemically treats separate zones of the well. For example, the chemical can be injected into the production zone and then transported by the second stream (water) into the injection zone. Accordingly both the production zone and the injection zone are chemically treated.

The production system of the invention is configured to perform the method of the invention. The production system includes the separation system for producing the separate streams, and the injection system for injecting the chemical into the well. The separation system includes a separator apparatus in fluid communication with an injection pump, and a hydrocarbon pump which are driven by a downhole motor. The injection pump pumps well fluid from the production zone into the separator apparatus, which in the illustrative embodiment comprises one or more hydrocyclones. Using fluid density differences, the separator apparatus separates the well fluid into the first stream (hydrocarbon), and the second stream (water). The hydrocarbon pump produces the first stream (hydrocarbon) through a hydrocarbon conduit, and the production tubing to the surface. The second stream (water) is injected through a discharge tube into the injection zone.

The injection system can utilize the well annulus as a conduit for the chemical, or alternately can utilize a separate conduit placed within the well annulus to a selected zone of the well. The production system also includes devices, such as well bore packers, for isolating the different zones of the well.

In a first embodiment the production system is configured for a well in which the production zone is above the injection zone. In a second embodiment the production system is configured for a well in which the production zone is below the injection zone.

DETAILED DESCRIPTION OF THE PREFERRED EMBODIMENTS

Figure 1A:
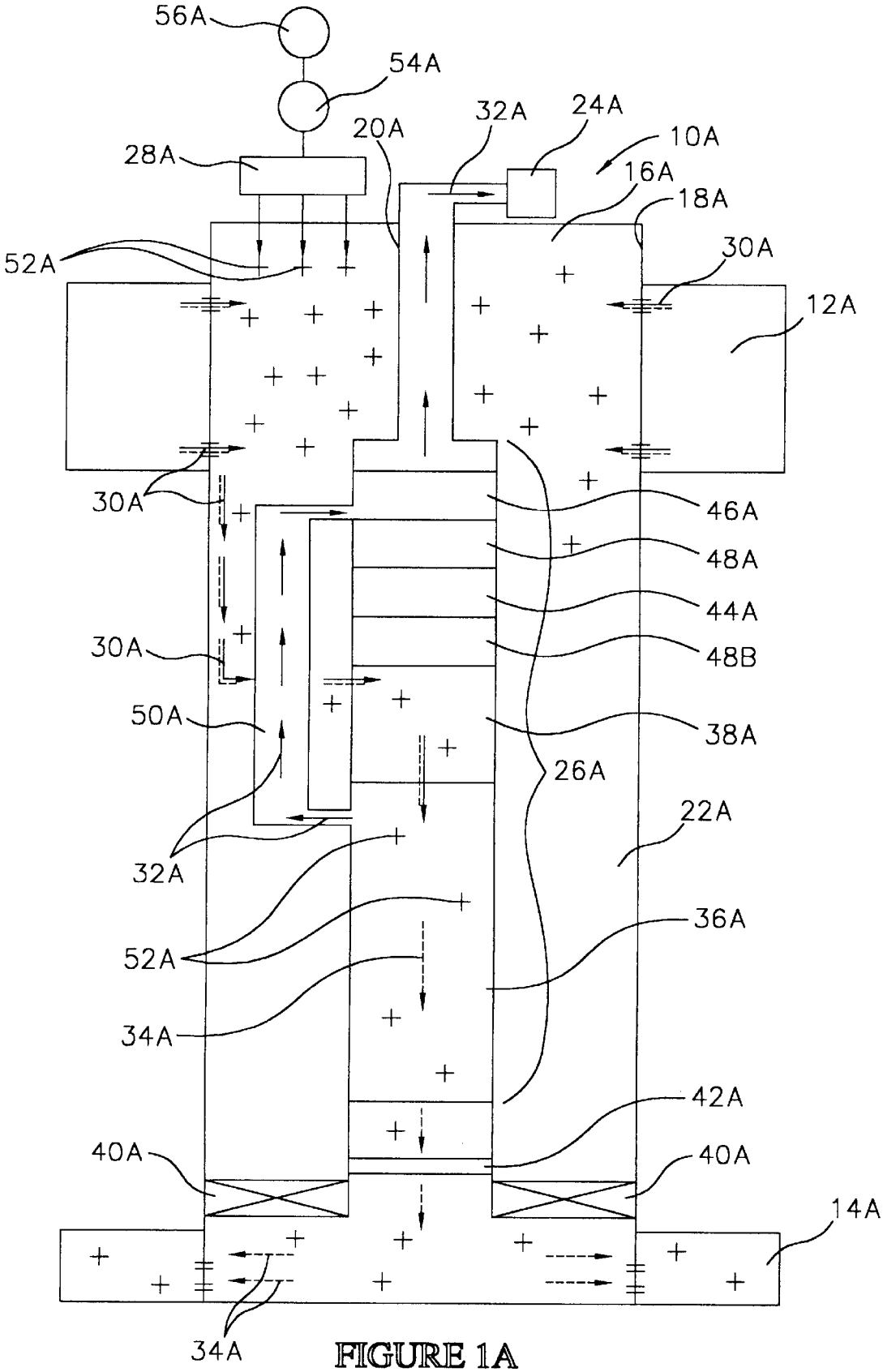
FIG. 1A is a schematic diagram illustrating the first embodiment of the method of the invention in a well having the production zone above the injection zone.

Referring to FIG. 1A, the first embodiment of the method of the invention is illustrated schematically. In this embodiment the method is performed on a conventional oil or gas production well 10A. The production well 10A extends from a surface 16A of the earth, through a production zone 12A, and to an injection zone 14A within the earth. In the production well 10A, the production zone 12A is above the injection zone 14A (i.e., the production zone 12A is closer to the surface 16A, than the injection zone 14A).

The surface 16A can be the ground, or alternately a structure, such as an oil platform located above water. In the illustrative embodiment, the production well 10A extends generally vertically from the surface 16A through the earth to the injection zone 14A. However, it is to be understood that the method can also be practiced on inclined wells, and on horizontal wells.

The production zone 12A comprises one or more formations containing a well fluid 30A, such as a mixture of water and hydrocarbons. The hydrocarbons can be in the form of oil, condensate or gas. As the well fluid 30A includes both hydrocarbons and water, it is represented in FIG. 1A by arrow heads with bifurcated tails, each having a solid segment and a dashed segment.

The injection zone 14A comprises one or more formations adapted to receive a discharge fluid which comprises a water stream 34A. The water stream 34A is represented in FIG. 1A by arrow heads with dashed tails. The water stream 34A comprises essentially water, and will be injected into the injection zone 14A.

The production well 10A includes a well casing 18A, a string of production tubing 20A within the well casing 18A, and a well annulus 22A 25 between the production tubing 20A and the well casing 18A. The production tubing 20A, which is also referred to in the art as a "tubing string", provides a conduit for transmitting a production fluid to the surface 16A. With the method of the invention, the production fluid is in the form of a hydrocarbon stream 32A which comprises essentially hydrocarbons. The hydrocarbon stream 34A is represented in FIG. 1A by arrow heads with solid tails. At the surface 16A, the production tubing 20A is in fluid communication with a receptacle 24A, such as a tank, for receiving and accumulating the hydrocarbon stream 32A.

For performing the first embodiment of the method, the production well 10A is provided with a fluid separation system 26A, and a chemical injection system 28A. The fluid separation system 26A is adapted to receive the well fluid 30A from the production zone 12A, and to separate the well fluid 30A into the hydrocarbon stream 32A and the water stream 34A.

The separation system 26A includes a separator apparatus 36A for separating the well fluid 30A into the hydrocarbon stream 32A and the water stream 34A. The separator apparatus 36A is in fluid communication with the production zone 12A, such that the well fluid 30A can be received for separation. The separator apparatus 36A is also in fluid communication with the injection zone 14A, such that the water stream 34A can be injected into the injection zone 14A. A well bore packer 40A isolates the injection zone 14A from the well annulus 22A, such that there is no fluid communication between the injection zone 14A and the well annulus 22A. In addition, a check valve 42A prevents fluid flow from the injection zone 14A into the separator apparatus 36A.

In the illustrative embodiment, the separator apparatus 36A comprises one or more "hydrocyclones". In general, a hydrocyclone employs fluid density differences to separate the well fluid 30A into the hydrocarbon stream 32A and the water stream 34A. Representative examples of separation systems employing hydrocyclones are disclosed in U.S. Pat. Nos. 5,296,153; 5,730,871; 5,343,945; and 6,017,456. However, it is to be understood that the method of the invention can be practiced with other types of separation systems which employ other types of separator apparatus such as filters, membranes, electrostatic devices, rotary vane separators, and centrifugal separators.

The separator system 26A also includes an injection pump 38A for pumping the well fluid 30A into the separator apparatus 36A. The injection pump 38A can comprise a centrifugal pump, a multi stage centrifugal pump, a cavity pump, or a gear pump. In addition, the separator system 26A includes a hydrocarbon pump 46A for pumping the hydrocarbon stream 32A through the production tubing 20A to the surface 16A. The hydrocarbon pump 46A is in fluid communication with the separator apparatus 36A via a hydrocarbon conduit 50A. The hydrocarbon pump 46A can comprise a rod pump, a centrifugal pump, a multi stage centrifugal pump, a cavity pump, or a gear pump.

The separator system 26A also includes a motor 44A for supplying power to the pumps 38A, 46A. Preferably the motor 44A comprises a downhole electric motor powered by an electric cable (not shown) from the surface 16A. An upper seal 48A and a lower seal 48AB protect and seal the motor 44A. Alternately separate motors can be used to power the pumps 38A, 46A.

Still referring to FIG. 1A, the injection system 28A is adapted to inject a chemical 52A into the injection zone 14A of the well 10A. The injection system 28A can include a chemical source 56A, such as a reservoir or vessel, which contains a supply of the chemical 52A. The injection system 28A can also include a pump 54A, or other mechanism, for injecting the chemical 52A through a conduit 60A, and through the well annulus 22A, into production zone 12A. Alternately, by running the conduit 60A within the well annulus 22A, generally parallel to the production tubing 20A, and through the packer 40A, the chemical 52A can be injected into the injection zone 14A.

The chemical 52A can comprise one or more compounds, or solutions containing compounds, which are configured to increase a productivity of the well 10A. Various chemical compounds for treating wells are well known in the art. Representative classes of compounds include surfactant compounds, wettability altering compounds, and remediating compounds. Representative chemicals include ethoxy alcohols and ethoxy sulfates.

As shown in FIG. 1A, the chemical 52A is injected by the injection system 28A through the well annulus 22A and into the production zone 12A. In the production zone 12A, the chemical 52A combines with the well fluid 30A, and is drawn with the well fluid 30A into the injection pump 38A of the separation system 26A. In the separator apparatus 36A, the chemical 52A separates from the well fluid 30A, and combines with the water stream 34A. The chemical 52A is then injected with the water stream 34A into the injection zone 14A of the well. The method thus treats both the production zone 12A and the injection zone 14A of the well 10A.

The chemical injection step can be performed a single time for a selected time period and then stopped in the manner of a "huff and puff" chemical treatment, Alternately, the chemical injection step can be performed continuously with production from the well 10A. As another alternative, the chemical injection step can be performed cyclically, by injecting during an injection interval, followed by no injecting during a non-injection interval. The intervals can be from minutes to days, and selected as required to achieve desired treatment of the well 10A.

Figure 1B:
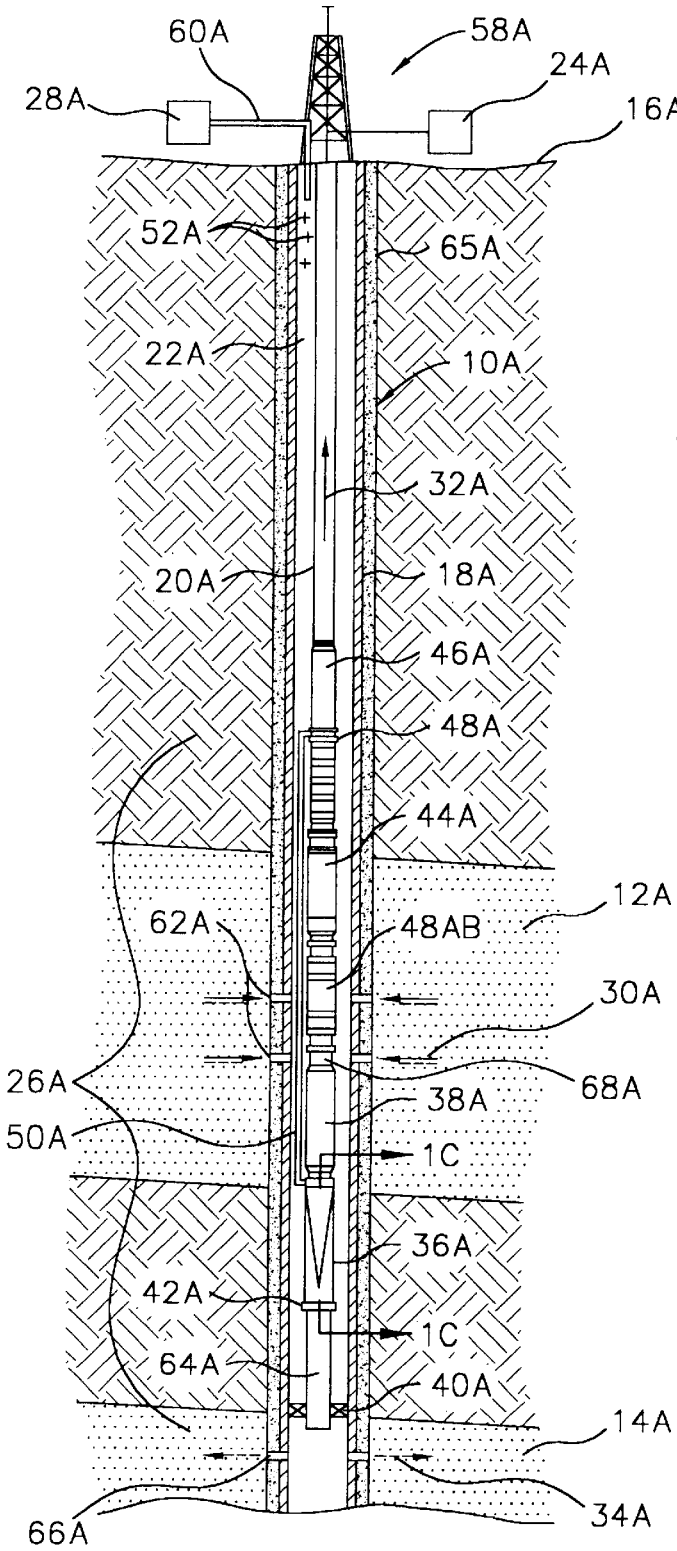
FIG. 1B is a schematic cross sectional view of the first embodiment production system for performing the method of FIG. 1A.

Referring to FIG. 1B, a production system 58A constructed to perform the method of FIG. 1A is illustrated. The production system 58A includes the separation system 26A and the chemical injection system 28A. The separation system 26A is located within the well casing 18A of the production well 10A proximate to the projection zone 12A.

The well casing 18A is of conventional design, and is embedded in concrete 65A. Openings 62A through the well casing 18A and the concrete 65A establish fluid communication between the production zone 12A and the well annulus 22A. This allows the well fluid 30A to flow into an intake 68A of the injection pump 38A. The injection pump 38A forces the well fluid 30A through the separator apparatus 36A. The injection pump 38A can be driven by the motor 44A, or alternately by its own separate drive motor.

The separator apparatus 36A separates the water stream 34A, which is forced through the check valve 42A, and through a discharge tube 64A into the injection zone 14A. Openings 66A through the well casing 18A and the concrete 65A establish fluid communication between the discharge tube 64A and the injection zone 14A.

The well bore packer 40A prevents the water stream 34A from flowing into the well annulus 22A, The well bore packer 40A can comprise a commercially available, retrievable, or permanent packer having an inflatable or compressible sealing elements.

In addition to separating the water stream 34A, the separator apparatus 36A separates the hydrocarbon stream 32A, which is transmitted through the hydrocarbon conduit 50A, and pumped by the hydrocarbon pump 46A, through the production tubing 20A to the surface 16A. The hydrocarbon pump 46A can be driven by the motor 44A, or alternately by its own separate drive motor.

Figure 1C:
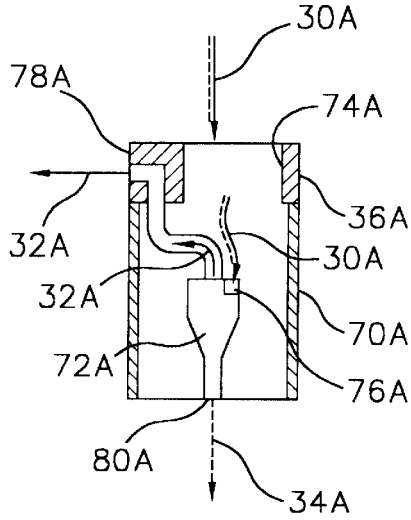
FIG. 1C is a cross sectional view of the separator apparatus of the system of FIG. 1B taken along section line 1C—1C of FIG. 1B.

Referring to FIG. 1C, the separator apparatus 36A is illustrated separately. The separator apparatus 36A includes a housing 70A and a hydrocyclone 72A mounted within the housing 70A. For simplicity only a single hydrocyclone 72A is illustrated, However, the separator apparatus 36A can use multiple hydrocyclones 72A using arrangements that are known in the art. For example, multiple hydrocyclones can be longitudinally aligned, helically arranged, radially arranged, or arranged in series nose to tail. In addition, the hydrocyclone 72A can be driven by a suitable drive mechanism (not shown) such as an electric motor.

Still referring to FIG. 1C, the housing 70A of the separator apparatus 36A includes an intake opening 74A for receiving the well fluid 30A from the injection pump 38A. The well fluid 30A is directed through an inlet opening 76A on an exterior of the hydrocyclone, and into the interior of the hydrocyclone 72A. The hydrocyclone 72A is configured to spin the well fluid 30A, and to separate the well fluid 30A into the hydrocarbon stream 32A and the more dense water stream 34A. A hydrocarbon outlet 78A of the hydrocyclone 72A directs the hydrocarbon stream 32A into the hydrocarbon conduit 50A (FIG. 1B). A water outlet 80A of the hydrocyclone 72A directs the water stream 34A into the discharge tube 64A (FIG. 1B).

Referring again to FIG. 1B, the chemical injection system 28A includes the conduit 60A in flow communication with the well annulus 22A. The chemical 52A can be injected through the conduit 60A into the well annulus 22A to the production zone 12A. Alternately, the conduit 60A can extend within the well annulus 22A, and through the packer 40A, for injecting the chemical 52A into the injection zone 14A.

Figure 2A:
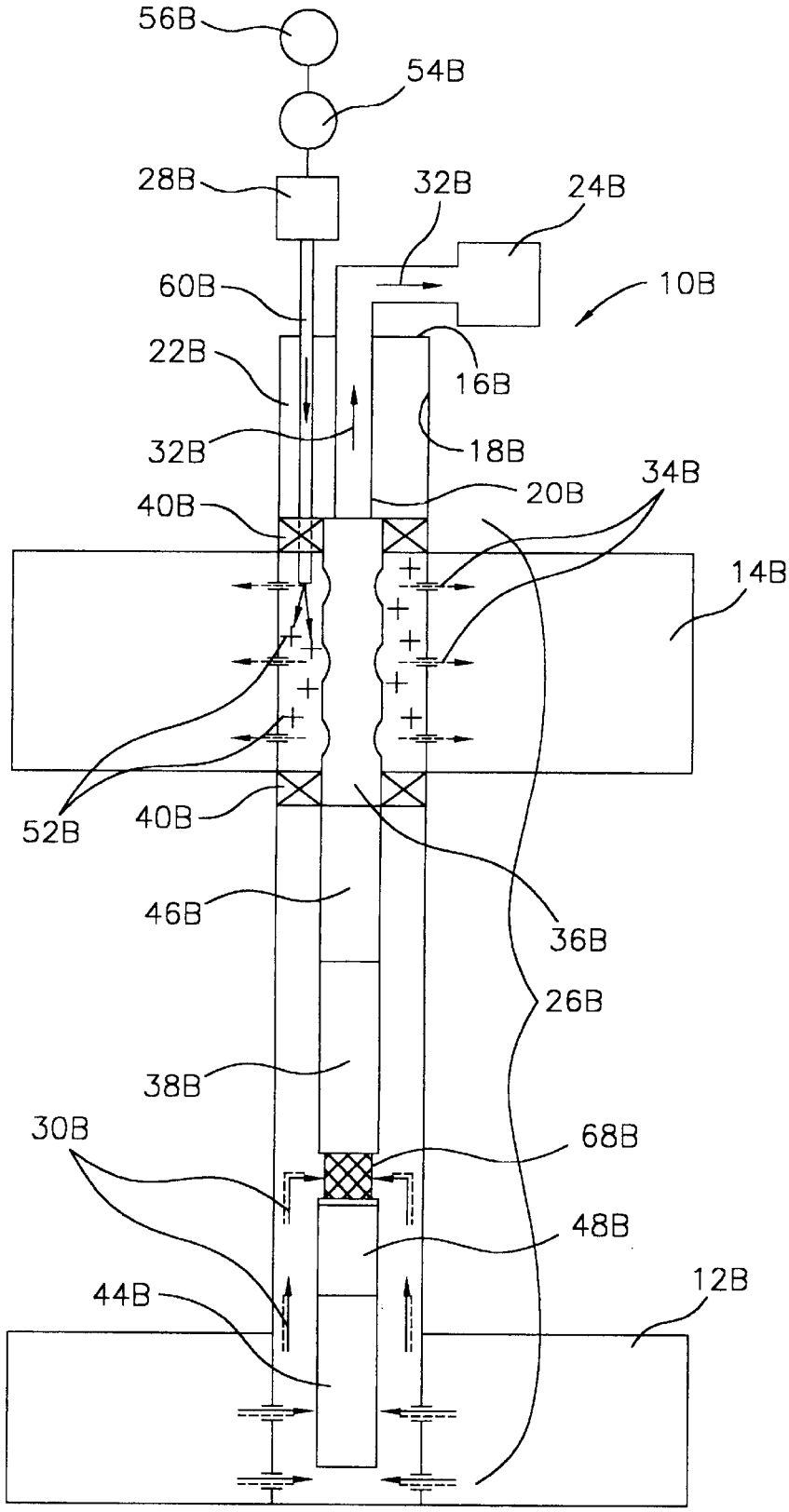
FIG. 2A is a schematic diagram illustrating the second embodiment of the method of the invention in a well having the production zone below the injection zone.

Referring to FIG. 2A, the second embodiment of the method of the invention is illustrated schematically. In this embodiment, the method is performed on a conventional oil or gas production well 10B having a production zone 12B which is below an injection zone 14B (i.e., the injection zone 14B is closer to the surface 16A than the production zone 12B).

The production well 10B includes a well casing 18B, a string of production tubing 20B within the well casing 18B, and a well annulus 22B between the production tubing 20B and the well casing 18B. At a surface 16B of the production well 10B, the production tubing 20B is in fluid communication with a receptacle 24B, such as a tank, for receiving and accumulating a hydrocarbon stream 32B.

For performing the second embodiment method, the production well 10B is provided with a fluid separation system 26B, and a chemical injection system 28B. The fluid separation system 26B is adapted to receive a well fluid 30B from the production zone 12B, and to separate the well fluid 30B into a hydrocarbon stream 32B and a water stream 34B. The hydrocarbon stream 32B is pumped through the production tubing 20B to the surface 16B while the water stream 34B is injected into the injection zone 14B. During production of the hydrocarbon stream 32B and the water stream 34B, the injection system 28B simultaneously injects a chemical 52B into the injection zone 14B of the well 10B.

The separation system 26B includes a separator apparatus 36B for separating the well fluid 30B into the hydrocarbon stream 32B and the water stream 34B. The separator apparatus 36B is in fluid communication with the injection zone 14B such that the water stream 34B can be injected into the injection zone 14B. A pair of well bore packers 40B isolate the injection zone 14A, such that there is no fluid communication between the injection zone 14B and the production zone 12B.

The separator apparatus 36B is also in fluid communication with an injection pump 38B. The injection pump 38B includes an intake opening 68B in flow communication with the production zone 12B. The injection pump 38B is configured to pump the well fluid 30B into the separator apparatus 36B. The separator apparatus 36B is also in flow communication with a hydrocarbon pump 46B. The hydrocarbon pump 46B is in flow communication with the production tubing 20B and is configured to pump the separated hydrocarbon stream 32B through the production tubing 20B to the surface 16B.

As will be further described, the separator apparatus 36B includes an arrangement of hydrocyclones. However, as with the previous embodiment, it is to be understood that the method can be practiced with other separation systems. Further details of the separator apparatus 36B, the injection pump 38B and the hydrocarbon pump 46B will become more apparent as the description proceeds.

The separator system 26B also includes a motor 44B for supplying power to the pumps 38B, 46B. Preferably the motor 44B comprises a downhole electric motor powered by an electric cable (not shown) from the surface 16B. Alternately, separate motors can be used to power the pumps 38B, 46B. A seal 48B protects and seals the motor 44B.

The injection system 28B can include a pump 54B, or other mechanism, for injecting the chemical 28B through a conduit 60B into the injection zone 14B. The conduit 60B comprises a capillary tube placed in the well annulus generally parallel to the production tubing 20B. The upper well bore packer 40B includes an opening for the conduit 60B, such that the chemical 52B can be injected directly into the isolated injection zone 14B. The injection system 28B can also include a chemical source 56B, such as a reservoir or vessel, which contains a supply of the chemical 28B. The chemical can comprise a compound as previously described for chemical 28A. In addition, as previously described, the chemical injection step can be performed a single time for a selected time period, continuously, or cyclically.

Figure 2B:
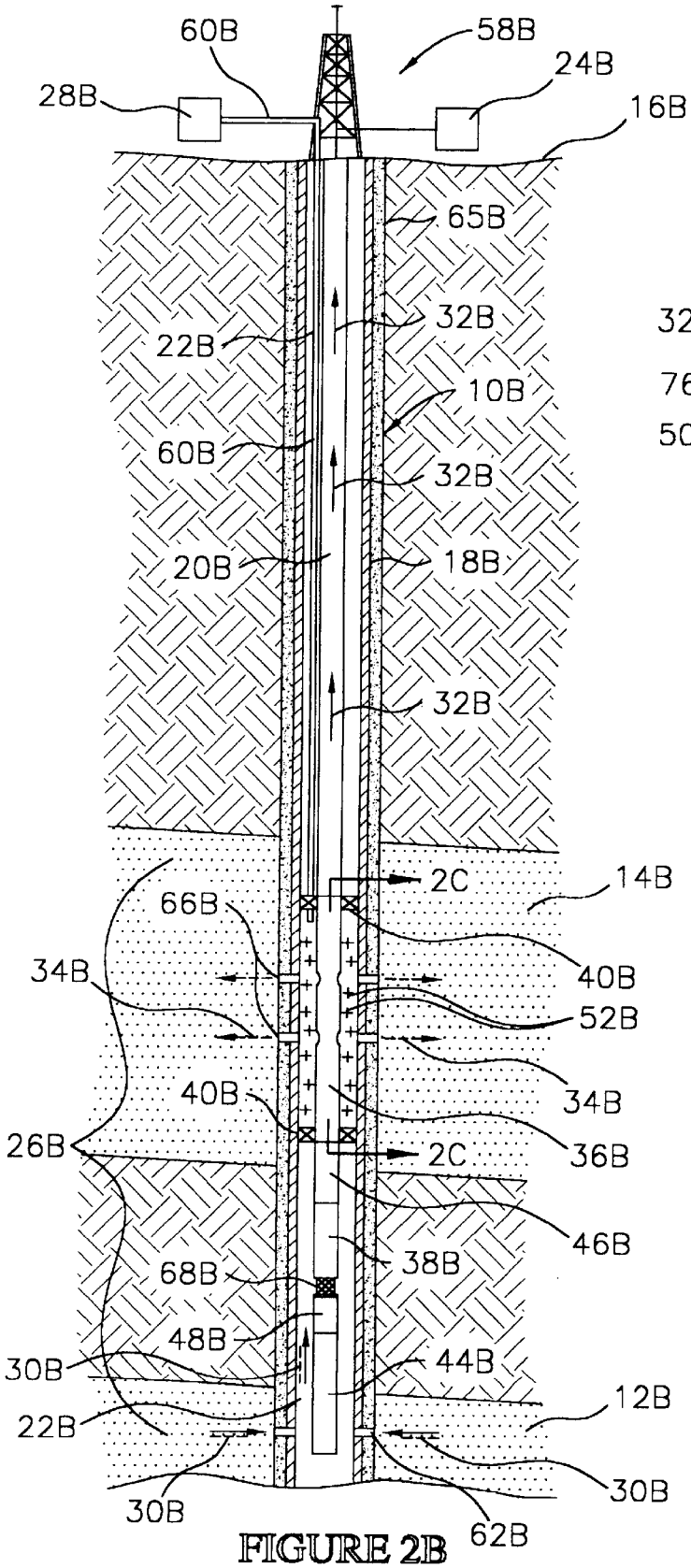
FIG. 2B is a schematic cross sectional view of the second embodiment production system for performing the method of FIG. 2A.

Referring to FIG. 2B, a production system 58B constructed to perform the method of FIG. 1B is illustrated. The production system 58B includes the separation system 26B and the chemical injection system 28B. The separation system 26B is located within the well casing 18B of the production well 10B proximate to the injection zone 14B.

The well casing 18B is of conventional design, and is embedded in concrete 65B. Openings 62B through the well casing 18B and the concrete 65B establish fluid communication between the production zone 12A and the well annulus 22B. This allows the well fluid 30B to flow into an intake 68B of the injection pump 38B. The injection pump 38B forces the well fluid 30B through the separator apparatus 36B. The separator apparatus 36B separates the water stream 34B, which is forced through openings 66B in the well casing 18B and the concrete 65B into the injection zone 14B. The hydrocarbon pump 46B pumps the hydrocarbon stream 32B to the surface. The hydrocarbon pump 46B and the injection pump 38B can comprise centrifugal pumps, multi stage centrifugal pumps, cavity pumps or gear pumps configured using arrangements that are known in the art. For example, one suitable configuration for the pumps 46B and 38B is disclosed in U.S. Pat. No. 5,730,871.

The well bore packers 40B isolate the injection zone 14B and prevent the water stream 34B from flowing into the well annulus 22B above the injection zone 14B. The well bore packers 40B can comprise commercially available, retrievable, or permanent packers having inflatable or compressible sealing elements.

Figure 2C:
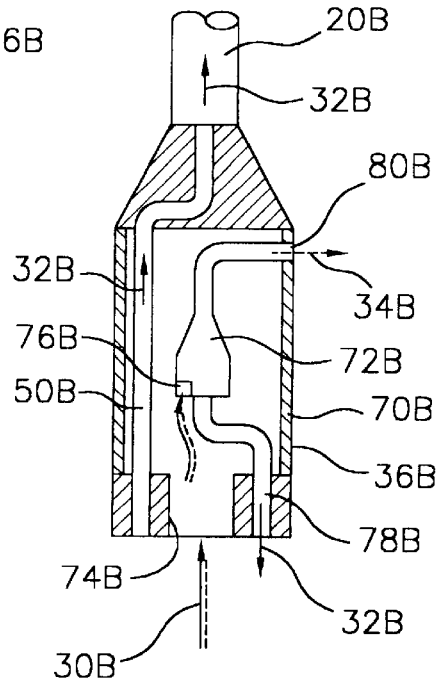
FIG. 2C is a cross sectional view of the separator apparatus of the system of FIG. 2B taken along section line 2C—2C of FIG. 2B.

In addition to separating the water stream 34B, the separator apparatus 36B separates the hydrocarbon stream 32B, which is transmitted by the hydrocarbon pump 46B, through the production tubing 20B to the surface 16B, Referring to FIG. 2C, the separator apparatus 36B is illustrated separately. The separator apparatus 36B includes a housing 70B, and a hydrocyclone 72B mounted within the housing 70B. For simplicity, only a single hydrocyclone 72B is illustrated. However, the separator apparatus 36B can use multiple hydrocyclones 72B using arrangements that are known in the art. For example, multiple hydrocyclones can be longitudinally aligned, helically arranged, radially arranged, or arranged in series nose to tail.

Still referring to FIG. 2C, the housing 70B of the separator apparatus 36B includes an intake opening 74B for receiving the well fluid 30B from the injection pump 38B. The well fluid 30B is directed through an inlet opening 76B on an exterior of the hydrocyclone and into the interior of the hydrocyclone 72B. The hydrocyclone 72B is configured to spin the well fluid 30B, and to separate the well fluid 30B into the hydrocarbon stream 32B and the more dense water stream 34B. The hydrocyclone 72B can be driven by a suitable drive apparatus, such as an electric motor supplied by power from the surface 16B.

A hydrocarbon outlet 78B of the hydrocyclone 72B directs the hydrocarbon stream 32B into a hydrocarbon conduit 50B formed integrally with the housing 70B. For simplicity the connecting conduits are not illustrated. The hydrocarbon conduit 50B is in fluid communication with the production tubing 20B such that the hydrocarbon stream 32B can be pumped to the surface using energy supplied by the hydrocarbon pump 46B. A water outlet 80B of the hydrocyclone 72B directs the water stream 34B into the injection zone 14B.

Referring again to FIG. 2B, the chemical injection system 28B includes the conduit 60B placed within the well annulus 22B and through the packer 40B to the well annulus 22B proximate to the injection zone 12B. This arrangement permits the chemical 52B to be injected through the conduit 60*b* into the well annulus 22B between the packers 40B, and into the injection zone 12B.

Thus the invention provides a method and a system for producing fluids in subterranean wells using simultaneous downhole separation and chemical injection. The method and system improve the production capabilities of hydrocarbon wells, reduce production costs, and provide environmental benefits.

While the invention has been described with reference to certain preferred embodiments, as will be apparent to those skilled in the art, certain changes and modifications can be made without departing from the scope of the invention as defined by the following claims.

What is claimed is:

1. A method for producing fluids from a subterranean well having a surface, a first zone and a second zone comprising:

providing a downhole separation system in the well configured to receive a well fluid from the first zone;

separating the well fluid into a first stream comprising a hydrocarbon and into a second stream comprising water using the downhole separation system;

injecting a chemical into the first zone during the separating step to treat the first zone;

combining the chemical with the second stream;

pumping the first stream to the surface; and injecting the second stream with the chemical therein into the second zone to treat the second zone.

2. The method of claim 1 wherein the first zone comprises a production zone and the second zone comprises an injection zone.

3. The method of claim 1 wherein the injecting step comprises injecting the chemical through a well annulus into the first zone.

4. The method of claim 1 wherein the injecting step comprises injecting the chemical through a conduit into the first zone.

5. The method of claim 1 wherein the injecting step is performed for a selected time period and then stopped while the separating step continues.

6. The method of claim 1 wherein the injecting step is performed continuously with the separating step.

7. A method for producing fluids in a subterranean well having a surface, a first zone and a second zone comprising:

providing a downhole separation system in the well configured to receive a well fluid from the first zone;

providing a chemical having an affinity for water;

separating the well fluid into a first stream comprising essentially a hydrocarbon, and into a second stream comprising essentially water using the downhole separation system, while simultaneously injecting the chemical into the first zone to treat the first zone;

combining the chemical with the second stream;

producing the first stream to the surface; and injecting the second stream with the chemical therein into the second zone to treat the second zone.

8. The method of claim 7 wherein the first zone comprises a production zone and the second zone comprises an injection zone.

9. The method of claim 7 wherein the chemical comprises a compound selected from the group consisting of surfactant compounds, wettability altering compounds and remediating compounds.

10. A method for producing fluids from a subterranean well having a surface, a production zone and an injection zone comprising:

providing a downhole separation system in the well configured to separate a well fluid from the production zone into a first stream comprised essentially of a hydrocarbon, and into a second stream comprised essentially of water;

providing a chemical injection system configured to inject a chemical into the injection zone;

separating the well fluid into the first stream and into the second stream using the separation system;

injecting the second stream with the chemical therein into the injection zone during the separating step using the separation system; and pumping the first stream to the surface.

11. The method of claim 10 wherein the separation system comprises at least one hydrocyclone.

12. The method of claim 11 wherein the separation system comprises a first pump in fluid communication with the production zone and the hydrocyclone configured to pump the well fluid from the production zone into the hydrocyclone.

13. The method of claim 12 wherein the separation system comprises a second pump in fluid communication with the hydrocyclone configured to pump the first stream to the surface.

14. The method of claim 10 wherein the injection zone is closer to the surface than the production zone.

15. The method of claim 14 wherein the chemical comprises a compound selected from the group consisting of surfactant compounds, wettability altering compounds and remediating compounds.

16. The method of claim 10 wherein the chemical has an affinity for the second stream.

17. The method of claim 10 wherein the injecting step is performed for a selected time period and then stopped while the separating step continues.

18. A method for producing fluids from a subterranean well having a surface, a production zone and an injection zone comprising:

placing a hydrocyclone in the well;

using the hydrocyclone to separate a well fluid from the production zone into a first stream comprising essentially a hydrocarbon, and into a second stream comprising essentially water;

simultaneously injecting a chemical into the production zone while separating the well fluid to treat the production zone, the chemical having an affinity for water such that the chemical combines with the second stream;

pumping the first stream to the surface; and disposing the second stream with the chemical therein into the injection zone to treat the injection zone.

19. The method of claim 18 wherein the chemical comprises a compound selected from the group consisting of surfactant compounds, wettability altering compounds and remediating compounds.

20. In a well having a production zone and an injection zone located above the production zone, a method for producing fluids from the well comprising:

injecting a chemical into the injection zone;

separating a well fluid from the production zone to produce a hydrocarbon stream and a water stream;

pumping the hydrocarbon stream to a surface of the well;

combining the chemical into the water stream; and injecting the water stream and the chemical into the injection zone to treat the injection zone.

21. The method of claim 20 further comprising providing a hydrocyclone proximate to the production zone and performing the injection step using the hydrocyclone.

22. The method of claim 20 wherein the injecting the chemical step is performed using a conduit placed in the well in fluid communication with the injection zone.

23. In a well having a production zone and an injection zone located below the production zone, a method for producing fluids from the well comprising:

injecting a chemical into the production zone to treat the production zone;

separating a well fluid from the production zone to produce a hydrocarbon stream and a water stream;

pumping the hydrocarbon stream to a surface of the well;

combining the chemical with the water stream; and injecting the water stream with the chemical therein into the injection zone to treat the injection zone.

24. The method of claim 23 wherein the chemical has an affinity for water.

25. A system for producing fluids from a subterranean well having a production zone and an injection zone comprising:

a chemical configured to treat the production zone and the injection zone;

an injection system configured to inject the chemical into the production zone to treat the production zone; and a separation system configured to separate a well fluid from the production zone into a first stream comprised essentially of a hydrocarbon, and into a second stream comprised essentially of water, to combine the chemical into the second stream and then to inject the second stream with the chemical therein into the injection zone to treat the injection zone.

26. The system of claim 25 wherein the chemical comprises a compound selected from the group consisting of surfactant compounds, wettability altering compounds and remediating compounds.

27. The system of claim 25 wherein the separation system comprises at least one hydrocyclone.

28. The system of claim 27 wherein the separation system comprises a first pump in fluid communication with the hydrocyclone configured to pump the well fluid from the production zone into the hydrocyclone.

29. The system of claim 28 wherein the separation system comprises a second pump in fluid communication with the hydrocyclone configured to pump the first stream to the surface.

30. A system for producing fluids from a well extending from a surface through a production zone and an injection zone within the earth, the system comprising:

a chemical;

an injection system configured to inject the chemical into the injection zone;

a separation system in the well comprising a hydrocyclone and a first pump configured to separate a well fluid from the production zone into a first stream comprising a hydrocarbon, and into a second stream comprising water, and to inject the second stream into the injection zone to combine the chemical with the second stream and treat the injection zone; and a second pump configured to pump the first stream to the surface.

31. The system of claim 30 wherein the injection system comprises at least one conduit in the well in flow communication with the injection zone.

32. The system of claim 30 wherein the injection system is configured to inject the chemical through a well annulus into the injection zone.

33. In a well comprising a well casing in fluid communication with a production zone and an injection zone, a system for producing fluids from the well comprising:

a chemical;

an injection system configured to inject the chemical into the production zone to treat the production zone;

a packer configured to isolate the production zone from the injection zone;

a separator apparatus in the well casing configured to separate a well fluid from the production zone into a first stream comprising a hydrocarbon, and into a second stream comprising water, and to combine the second stream with the chemical;

a first pump configured to pump the well fluid into the separator apparatus and to inject the second stream and the chemical into the injection zone to treat the injection zone; and a second pump configured to pump the first stream to a surface of the well.

34. The system of claim 33 wherein the separator apparatus comprises at least one hydrocyclone.

35. The system of claim 34 wherein the chemical comprises a compound selected from the group consisting of surfactant compounds, wettability altering compounds and remediating compounds.

36. The system of claim 35 wherein the chemical has an affinity for water.

37. The system of claim 36 wherein the production zone is below the injection zone.

* * * * *